United States Patent [19]

McCarthy

[11] 4,030,605

[45] June 21, 1977

[54] HOLDER AND DISPENSER FOR REMOVABLE JEWELRY INSERTS

[76] Inventor: Joseph J. McCarthy, 264 Broadway, Malden, Mass. 02148

[22] Filed: June 14, 1976

[21] Appl. No.: 695,782

[52] U.S. Cl. ..... 206/525; 63/26; 63/29 R; 206/526

[51] Int. Cl.[2] ..... B65D 85/54

[58] Field of Search ..... 206/525, 526; 63/26, 63/29 R, 15; 224/28 F; 179/1 G; 29/8, 10; 125/30 R; 248/315

[56] References Cited

UNITED STATES PATENTS 3,273,766 9/1966 Consentino ..... 63/29 R X 3,626,718 12/1971 Schneider ..... 63/29 R

*Primary Examiner*—George T. Hall

*Attorney, Agent, or Firm*—Fisher, Christen & Sabol

[57] ABSTRACT

Holder and dispenser for removable jewelry inserts which comprises a tube sufficiently large to fit over a human finger and a plurality of holding means on the exterior of said tube for releasably holding removable jewelry inserts. In a preferred embodiment, the holding means is located adjacent an end of the tube and comprises a recess having a bottom, an end wall remote from the end of the tube, an open end adjacent the end of the tube, undercut sides extending substantially longitudinally of said tube from said open end to said end wall, and an open top.

10 Claims, 5 Drawing Figures

HOLDER AND DISPENSER FOR REMOVABLE JEWELRY INSERTS

BACKGROUND OF THE INVENTION

1. Field of the Invention

The invention relates to a device for holding and dispensing removable jewelry inserts for jewelry, such as rings, bracelets, and the like. The device is also useful in selecting a desired removable jewelry insert held by the device and facilitates loading of the insert onto the ring, bracelet or other piece of jewelry. The present invention provides an easy to use device for holding removable jewelry inserts which, in many cases are tiny and hard to handle. The novel device of this invention is capable of holding a plurality of jewelry inserts, such as gemstones and can hold as many as ten or twelve or even more of such inserts. The novel device is easily gripped by one finger and held while the other hand or other fingers of the same hand manipulate the desired removable jewelry insert to release it from the device and place it in the ring, bracelet or other jewelry where it is locked therein. The novel device of this invention provides a means whereby the user can compactly and safely store the jewelry inserts and have them presented for viewing and easy selection. For example, in using the device to change the stone or gem on a ring having a removable stone or gem insert, the device can be easily slipped onto the finger holding the ring, the stone or gem can be easily slipped off of the ring and into an empty holding means on the device. The device can be rotated while on the finger until the desired replacement insert is reached at which time the replacement insert can be slid onto the ring.

2. Description of the Prior Art

Heretofore numerous types of rings having removable jewelry inserts have been devised. For example, U.S. Pat. Nos. 435,068, 1,889,862, 1,704,867 and 2,530,432 disclose rings which contain inserts, such as gemstones, onyx or other ornaments, such as cameo, which are slidable into the ring where it is held firmly during use by a variety of means, such as clasps, lock pins or other retaining members. For example, U.S. Pat. No. 1,704,867 provides a recess 3 for receiving a piece of onyx or other stone and elongated strip 12 which is hinged to the ring and adapted to be swung into a closed position holding the stone in the recess. The retaining strip can be held in closed position by forming a rounded free end thereon which is snapped into a lip 14 formed on the ring. Another patent which illustrates a recess having undercut sides in U.S. Pat. No. 1,889,862 wherein a recess is provided in the ring having tapered side walls such that the bottom of the recess is wider than the top in such manner that a similar shaped insert which is slipped into the recess will be held therein and will not fall out.

U.S. Pat. No. 435,068 shows a similar removable jewelry insert.

U.S. Pat. No. 2,253,353, 2,316,225, 2,653,402, 2,674,107 3,039,279 and 3,626,718 each describe different holding means for retaining a removable jewelry insert in the ring or other piece of jewelry.

The jewelry described in the above-mentioned patents utilizing removable jewelry insert have never become popular despite the obvious advantages of being able to change the appearance and color of the insert, such as a gemstone or in other cases to change the type of insert or gemstone to suit the particular occasion or the particular dress of the wearer. It is believed that the lack of success of prior removable jewelry inserts has been the difficulty in which the inserts, being in many cases tiny and difficult to handle, are not easily removed from the ring, stored or subsequently easily selected, retrieved or reinserted into the ring.

A search has been conducted for the concept of a tube adapted to fit and be gripped by a human finger in combination with removable jewelry insert holding means on the outside surface of the tube. No prior art was found to disclose, teach or suggest this concept. The closest prior art includes U.S. Pat. No. 1,480,427 which discloses a display tray for collar button which is rectangular in plan and cross-section.

Also, U.S. Pat. No. 1,939,642 describes a card for holding buttons which is made from a flat sheet of cardboard or heavy paper and which is rectangular.

In addition, U.S. Pat. No. 3,297,150 describes a display device for displaying and storing artificial finger and toe nails. The device of this patent comprises a tray of substantially rectagular shape in plan and cross-section having numerous recesses and cavities having undercut sides which permit the nails to be slid into and out of the recesses. None of the above-mentioned patents disclose or suggest a jewelry insert holding and dispensing device made of a tube adapted to fit a finger on the outside of which tube there is provided holding means for jewelry inserts.

SUMMARY OF THE INVENTION

The present invention is based on the discovery that a tube having removable jewelry insert holding devices on its outside surface can be easily held by the finger of the operator and rotated to select and properly position the desired insert or gemstone. The present invention provides a device which can hold a large number of removable jewelry inserts, such as gemstones and other ornamental inserts in plain view to facilitate selection and use of the selected gemstone. In particular, the device comprises a tube having a sufficiently large channel in it to receive a human finger which is used to position and grip the tube. The channel running through the tube can be unobstructed or, if desired, it can be closed in the center just as long as there is sufficient room to permit insertion of a finger for gripping thereby and selection and removal of the insert.

The device of this invention can be extremely inexpensive yet highly useful in the storing, selection and interchanging of removable jewelry inserts. It also provides a device whereby such inserts can be safely held and stored without fear of losing or damaging the jewelry inserts held thereby. The device is compact and can be easily transported in a pocket or in a lady's purse. If desired, an outer case can be provided into which the holder and dispenser of the present invention can be fit to provide additional protection for the gemstone or other jewelry inserts held thereby.

DESCRIPTION OF A PREFERRED EMBODIMENT

Figure 1:
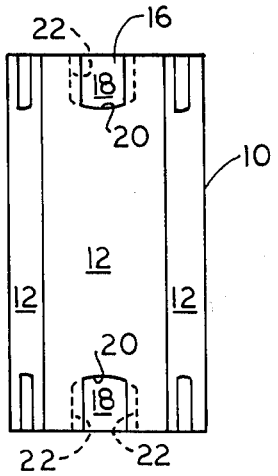
FIG. 1 is a side elevation view of one embodiment of the invention.
Figure 2:
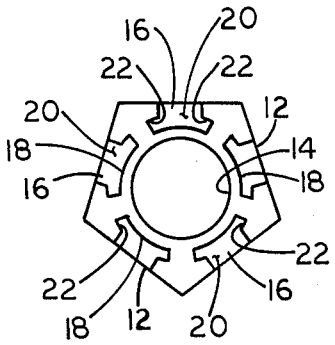
FIG. 2 is an end view of the embodiment shown in FIG. 1 illustrating a pentagonal cross-section.

Referring to FIGS. 1 and 2, there is shown a tube 10 of a pentagonal cross-section having five flat faces 12 and a central channel 14. Each flat face of tube 10 is formed with a recess 16 having a bottom 18, an end wall 20 remote from the ends of the tube 10 and undercut side walls 22 extending substantially longitudinally from the end wall 20 to the end of the tube.

Figure 3:
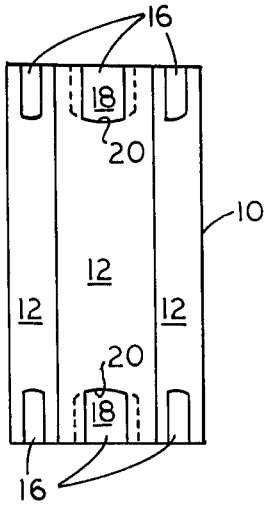
FIG. 3 illustrates another embodiment.
Figure 4:
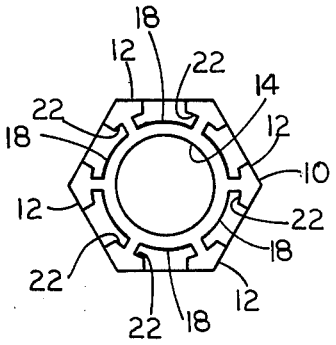
FIG. 4 is an end view of the embodiment of FIG. 3 illustrating the hexagonal cross-section of the device shown.

Referring to FIGS. 3 and 4, there is shown a tube 10 having a hexagonal cross-section and six flat faces 12. The tube 10 is formed with a center channel 14. The tube is also formed with a plurality of recesses 16 formed in the flat faces 12 at each end of the tube. Each recess has a bottom 18, an end wall 20 which is remote from the ends of the tube and sidewalls 22 which are undercut and which extend substantially longitudinally along the tube from the end wall to the end of the tube. The top of the recess is open.

Figure 5:
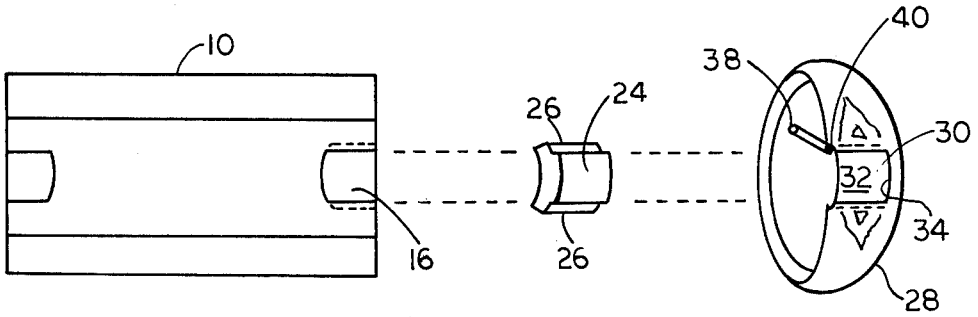
FIG. 5 is a side elevation illustrating the holder-dispenser device of this invention and a ring adapted to receive and hold removable jewelry inserts and a jewelry insert positioned between the device and the ring to illustrate the path of travel of the insert between the ring and the device.

Referring to FIG. 5, a gemstone 24 is shown formed with a lip 26 along each side. The gemstone 24 is adapted to slide into the recess 16 so that the lips 26 slide along the ways or grooves formed by the undercut sidewalls 22 and are held thereby to prevent the gemstone 24 from falling out. The grooves or ways formed by the undercut sidewalls 22 can be so sized that they frictionally grip the lips 26 to prevent the gemstone 24 from sliding out. A ring 28 is also shown in FIG. 5 and is similarly formed with a recess 30 having a bottom wall 32, and end wall 34 and two undercut sidewalls 36 extending from the end wall 34 to the other side of the ring. A gate 38 is provided to swing on hingepoint 40 to close when the gemstone 24 is disposed within the recess 30. Provision is made for a snap or other securing means to hold gate 38 in its closed position. The ways or grooves formed in the sidewalls 36 can be so sized as to provide frictional gripping against the lips 26 of the gemstone 24 further facilitating the retainment of the gemstone in the ring. The ring can be constructed in any suitable fashion, for example, as shown in U.S. Pat. Nos. 435,068; 1,889,862; 1,704,867; and 2,530,432, the disclosures of which are incorporated herein by reference.

Further embodiments will be readily apparent to those skilled in the art. For example, the outer surface need not be planar, i.e., the cross-section need not be pentagonal or hexagonal but can be circular in which case the tube 10 will be shaped like a cylinder. The cross-section of the device can be square-shaped, shaped in the form of any parallelogram, triangular-shaped, or any curvilinear shape, e.g., elliptical or oblong shape, as desired, to fit ornamental needs or special situations. In addition, where the cross-section is parallelogram-shaped, the number of flat faces on the tube can be varied to any desired degree. For example, an octagonal cross-sectional tube might be desired. When intended for use in holding and dispensing ring inserts, the device should be so shaped and sized that it conveniently fits between the fingers adjacent to the one on which the device is slipped. Also, the bottom of the recess can be open either partially or totally, so long as grooves or ways are provided in the side walls of the recess to grip and hold the insert. There are many suitable plastics from which the device of this invention can be made. The device can be formed of wood or metal or of any other material as may fit the particular needs or application of the device. As mentioned previously, an outer case for the device can be provided to protect the inserts when the device is stored in it. The case can be lined with a suitable soft liner such as jewelry cloth or soft plastic or cloth of any suitable type, such as valour, to further protect the inserts from scratching or other damage. Other modifications and changes can be clearly made within the scope of the present invention.

What is claimed is:

1. Holder and dispenser for removable jewelry inserts comprising a tube sufficiently large to receive a human finger and a plurality of holding means on the exterior of said tube for releasably holding removable jewelry inserts.

2. Holder and dispenser as claimed in claim 1 wherein each said holding means is located adjacent the ends of said tube.

3. Holder and dispenser as claimed in claim 2 wherein each said holding means comprises a recess having a bottom, an end wall remote from the ends of said tube, undercut sides extending substantially longitudinally along said tube and an open end adjacent one of said tube.

4. Holder and dispenser as claimed in claim 1 wherein said tube has a cylindrical inner wall and an outer wall formed of five intersecting planes and wherein the outer periphery of a cross-section of tube is a pentagon.

5. Holder and dispenser as claimed in claim 4 wherein each said plane has a said holding means at each end thereof.

6. Holder and dispenser as claimed in claim 3 wherein at least one of said recesses contains a gemstone insert for a ring.

7. Holder and dispenser as claimed in claim 5 wherein said holding means comprises a recess having a bottom, an end wall remote from the ends of said tube, an open end adjacent one end of said tube and undercut sides extending substantially longitudinally of said tube between said end wall and said open end.

8. Holder and dispenser as claimed in claim 6 wherein said tube is made of plastic and said recess is so sized that said gemstone insert is frictionally gripped and held in said recess.

9. Holder and dispenser as claimed in claim 1 wherein said tube has a substantially cylindrical inner wall and an outer wall formed of six intersecting planes and wherein the outer periphery of a cross-section of the tube is a hexagon.

10. Holder and dispenser as claimed in claim 9 wherein a gemstone insert for a ring is held by said holding means.

* * * * *